United States Patent [19]

Martin

[11] 4,267,035

[45] May 12, 1981

[54] PRESSURIZED ROTARY SCREENING APPARATUS

[75] Inventor: Andrew C. Martin, Middletown, Ohio

[73] Assignee: The Black Clawson Company, Middletown, Ohio

[21] Appl. No.: 70,209

[22] Filed: Aug. 27, 1979

[51] Int. Cl.[3] ..... B07B 1/20

[52] U.S. Cl. ..... 209/273; 209/306; 210/213

[58] Field of Search ..... 209/250, 268, 270, 273, 209/300, 305, 306, 380; 210/213

[56] References Cited

U.S. PATENT DOCUMENTS

| | | | |
|---|---|---|---|
| 1,145,097 | 7/1915 | Thoresen et al. | 209/273 |
| 2,899,064 | 8/1959 | Cowen et al. | 210/219 |
| 2,942,731 | 6/1960 | Soldini | 209/270 X |
| 3,081,873 | 3/1963 | Cowen et al. | 209/273 |
| 3,243,041 | 3/1966 | Cowan | 209/273 |
| 3,245,535 | 4/1966 | Cowen | 209/240 |
| 3,713,536 | 1/1973 | Hooper | 209/273 |

FOREIGN PATENT DOCUMENTS 1007576 3/1977 Canada .

*Primary Examiner*—William A. Cuchlinski, Jr.
*Attorney, Agent, or Firm*—Biebel, French & Nauman

[57] ABSTRACT

A rotary screening apparatus is provided for separating impurities in suspensions such as paper pulp or other slurries. The apparatus has a pressurized housing with a cylindrical screenplate separating the housing into an outer annular accepts chamber and an inner feed chamber. An impeller with one or more blades is mounted inside the feed chamber and imparts a rotary motion to the slurry. A series of horizontal baffles attached to the impeller divide the feed chamber into at least three sections. Piping is provided to inject dilution liquid into at least the lower two sections at separately controllable rates to compensate for the dewatering which occurs in the inlet section. The ability to treat and control individually each successive section of the screening device enables essentially complete separation of desirable fibers from impurities.

10 Claims, 3 Drawing Figures

PRESSURIZED ROTARY SCREENING APPARATUS

BACKGROUND OF THE INVENTION

This invention relates to rotary screening of slurries to remove objectionable impurities, and more particularly to vertical pressure pulp screens to remove debris from pulp slurries and paper making stock.

The production of paper making fibers by any known pulping method is incomplete in that certain portions of the wood are not broken down into individual fibers. Such wood portions, which include debris such as shives, bark, slivers, and chop, as well as foreign particles such as sand, grit, and pieces of metal and plastic must be removed from the paper making fibers before the manufacture of paper can begin. This removal can be accomplished either by centrifugal cleaning to separate high specific gravity particles from good paper making fibers or by screening to separate large surface area particles from good paper making fibers.

In recent years, pressurized rotary screens have become the most common type of screening apparatus in use. These screening devices generally have a pressurized housing with a cylindrical screen plate dividing the housing into an inner chamber and an outer annular chamber and a rotor in the proximity of the screenplate. The slurry to be screened is introduced into the inner chamber and has both a rotary and axial velocity imparted to it by the rotor. The cylindrical plate has slots or holes through which the desirable or accepts fibers pass while the undesirable or rejects particles are retained by the cylindrical screen plate. The accepts and rejects streams are then separately removed from the screening apparatus.

In modern rotary screens, two mechanisms are commonly used to maintain the screens in an open or unplugged condition. The first mechanism uses hydraulic action or pulsation to maintain the screens in an open and clean condition by generating an intermittent reverse flow of liquid through the holes or slots. Many modern screens utilize rotary motion to generate a cyclic reduction of pressure on the inlet side of the screenplate to accomplish this reverse flow. Typically, a rotating element equipped with foils or other cleaning structure is located on the inside of the screenplate and moves in proximity to the surface of the screenplate. The shape of the rotating elements is such that they create a positive pressure ahead of them and a suction in their wake. This hydraulic action or pulsation prevents the holes or slots in the screenplate from plugging.

The second mechanism involves rotation of the entire mass of pulp inside the screenplate cylinder at high velocity using a rotor with blades. Adjacent to the screenplate, a mat of fibers forms due to the dewatering action of the screen. At the tip of the rotor blade the fiber mat is rotating at a high speed while at the screenplate holes, the velocity is essentially zero. This results in large shear forces which align the fibers parallel with the screenplate. Since most undesirable impurities in paper pulp slurries are both longer and stiffer than the desirable fibers, the shear forces set up at the screenplate tend to prevent these impurities from passing through the holes.

A number of rotary screen apparatuses utilize the rotational mechanism to remove impurities. Examples of such apparatuses are Cowan, U.S. Pat. No. 3,081,873; Cowan, U.S. Pat. No. 3,245,555; Hooper, U.S. Pat. No. 3,713,536 and Martin, Canadian Pat. No. 1,007,576. However, the early Cowan patents suffer from the disadvantage that they cannot be operated under pressure. The Hooper patent, by adding dilution water through nozzles located at the tip of the rotor blades, tends to force undesirable particles located at a screenplate opening through that opening and into the accepts chamber when a rotor blade passes over the opening. Moreover, none of the above patents makes full use of the presence of the mat of fibers which acts to screen out undesirable fibers.

Accordingly, the need still exists in this art for a rotary pressure screen which can efficiently and effectively achieve essentially complete separation of desirable fibers from undesirable fibers and other particles in a pulp slurry.

SUMMARY OF THE INVENTION

In accordance with the present invention, there is provided a pressurized rotary screening device for the removal of impurities from suspensions of paper pulp or other solid-liquid slurries. The device has a pressurized housing with a cylindrical screen which divides the housing into an annular outer accepts chamber and an inner feed chamber. An impeller with one or more blades is mounted in the feed chamber. The impeller may be either cylindrically or frustoconically shaped or a combination of the two. The blades extend radially outwardly from the rotor to a point adjacent the screen.

A plurality of generally horizontally oriented baffles are also attached to the impeller and extend outwardly therefrom to divide the area between the impeller and screen into at least three compartments. Means are also provided for the supply of dilution liquid into at least the lower two compartments at separately controllable rates.

The inlet section of the apparatus, defined by the upper portion of the impeller, the screen, and the topmost horizontal baffle, provides a relatively deep (in the radial direction) chamber and relatively long initial residence time for the slurry in which rapid fiber mat formation and acceptance through the screen of a substantial portion of desirable short fibers is encouraged. The pulp slurry is injected tangentially into this inlet section to impart an immediate rotary motion to it which results in a rapid fiber mat formation at the screenplate. Backmixing of the slurry occurs in the inlet section between the rotor blades which insures adequate mixing of the slurry and increases the amount of good short fibers accepted through the screen. In a preferred embodiment, perforations in the screen opposite the inlet section are smaller than for the remainder of the screenplate.

The center section of the apparatus, defined by the area between the impeller, screenplate, inlet section, and rejects section, serves the dual purpose of accepting somewhat longer good fibers and washing off the remaining good fibers from the impurities. The pulp leaving the inlet section is rich in long fibers and impurities and is of increased consistency. At this stage, further mixing of the pulp slurry is discouraged by decreasing the area between the impeller and screenplate and confining the pulp. Separately controlled dilution liquid inlets provide liquid both to the upper portion of the center section to compensate for the dewatering which occurred in the inlet section and to the lower portion of the center section to wash good fibers from impurities still present in the pulp. The dilution liquid is added at or near the wall of the impeller so that the fiber mat formation at the surface of the screen is not disturbed.

In the rejects section, defined by the area between the base of the impeller, the screenplate, and the lowermost horizontal baffle, a separately controlled supply of dilution liquid is added to the remaining pulp which now consists mainly of impurities and rejects. Any remaining good fiber is flushed from the impurities by the addition of dilution liquid and is accepted through the screenplate. The retained rejects are then discharged from the apparatus.

Accordingly, it is an object of the present invention to provide a pressurized rotary screen to separate efficiently essentially all desirable pulp fibers from a pulp slurry containing impurities. This and other objects and advantages of the invention will become apparent from the following description, the accompanying drawings, and the appended claims.

DESCRIPTION OF THE PREFERRED EMBODIMENTS

Figure 1:
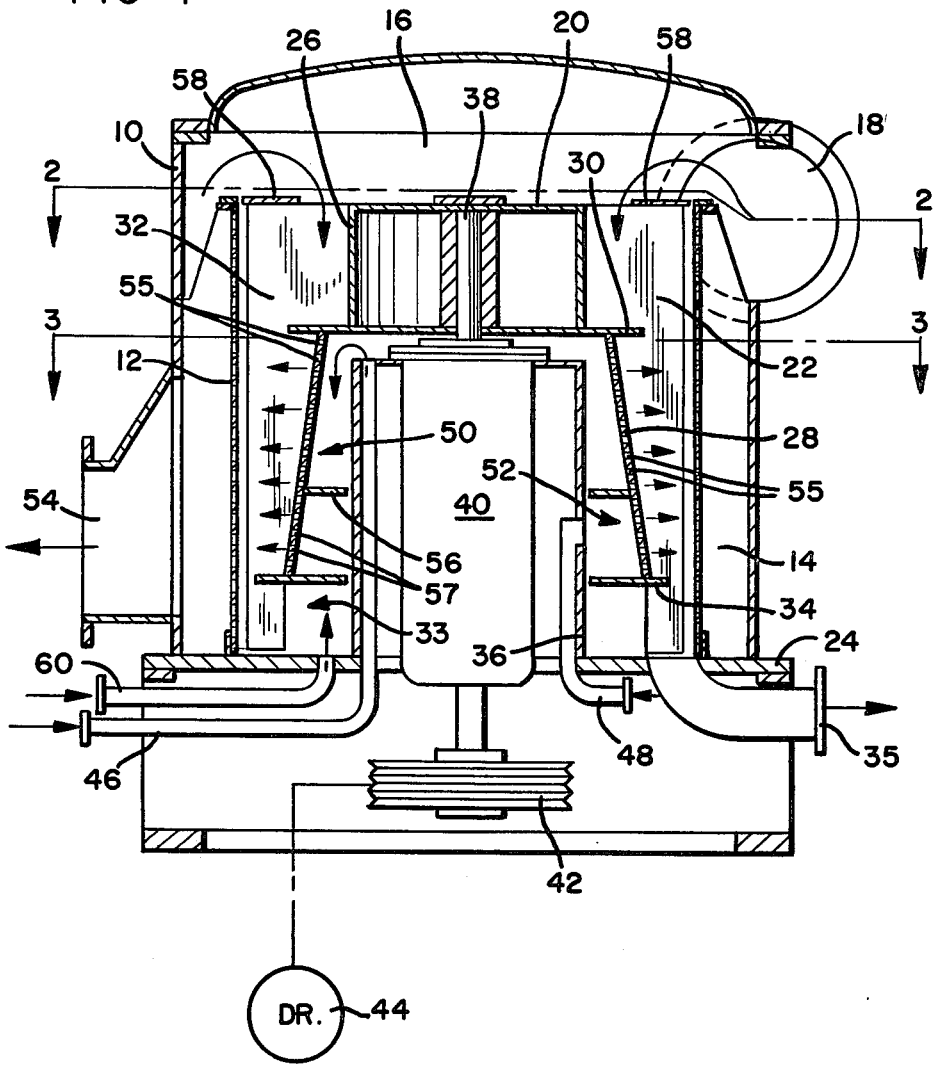
FIG. 1 is a sectional view of the rotary screen of the present invention.
Figure 2:
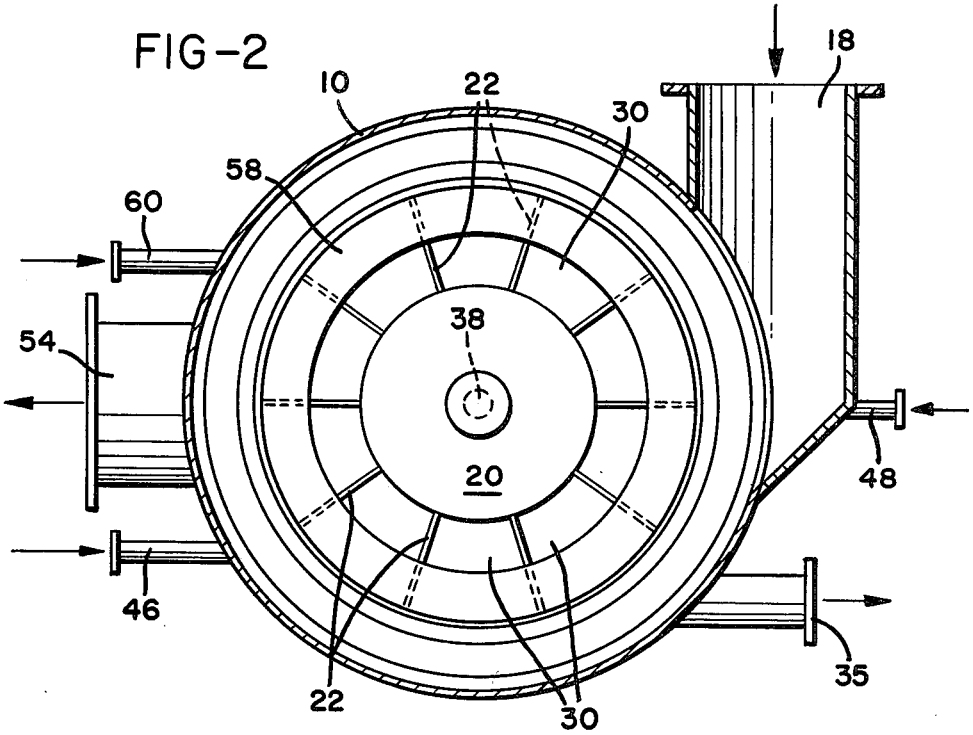
FIG. 2 is a horizontal section taken along line 2—2 in FIG. 1.
Figure 3:
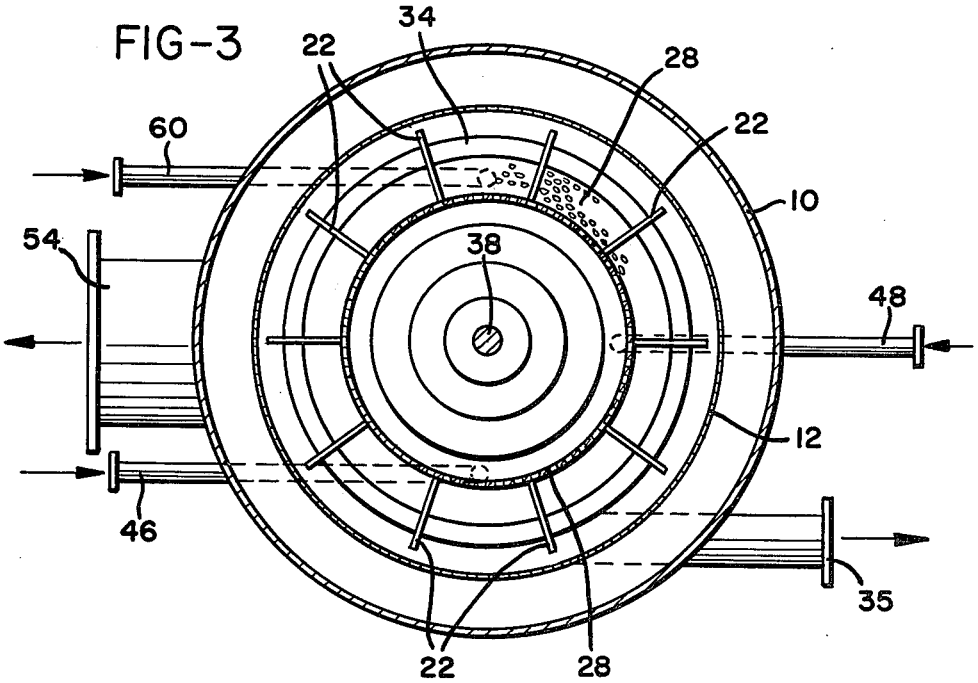
FIG. 3 is a horizontal section taken along line 3—3 in FIG. 1.

As shown in the Figures, a pressurized rotary screening device in accordance with the present invention comprises a pressurized housing 10 having a cylindrically-shaped screenplate 12 with slots or holes therein dividing the housing into an annular outer chamber 14 and an inner chamber 16. The slurry to be screened enters inlet 18 and is introduced into chamber 16.

A rotating impeller 20 is located with its vertical axis concentric to screenplate 12 and is equipped with at least one blade 22 mounted to extend radially from the central section of impeller 20. In the embodiment shown, ten blades are arranged equidistantly about the circumference of impeller 20. Blades 22 are in line with the top part of impeller 20 and extend past its lower edge to a point just above base 24 of the housing.

Impeller 20 consists of two sections. The upper portion 26 is of a cylindrical configuration and, in a preferred embodiment, has a diameter less than lower frustoconically shaped section 28. This provides additional volume for circulation and mixing of the slurry as it enters the inlet chamber. The diameter of upper portion 26 can be as little as half that of the inner diameter of screenplate 12 and its height may be about one-third that of the length of the screenplate. These dimensions can be varied, however, to accommodate slurries having different consistencies and a different mix of short versus long fibers. A generally horizontally oriented baffle or plate 30 divides the upper and lower portions of impeller 20 and defines the boundary between the inlet section of the apparatus and a central stock treatment section. Baffle 30 has a diameter greater than that of upper portion 26 of impeller 20 and slightly less than the inner diameter of screenplate 12. As shown, baffle 30 extends substantially circumferentially around impeller 20 and leaves a small annular opening 32 between its outer edge and the inner edge of the screenplate to provide for the undisturbed passage of the fiber mat which forms during operation of the apparatus at the inner surface of screenplate 12.

The lower portion 28 of impeller 20 is preferably frustoconical in shape with its lower edge having a diameter greater than that of its upper edge. Typically, the diameter of the upper edge is at least as great or greater than the diameter of cylindrical upper portion 26, although this may vary depending upon the types of slurries to be screened. The volume between the edge of portion 28 and screenplate 12 is such that the amount of slurry transferred from the inlet section can be handled but is small enough to discourage circulation and backmixing of the slurry between blades 20.

The bottom edge of lower portion 28 has a generally horizontal baffle or plate 34 extending both inwardly and outwardly therefrom which serves to define the boundary between the central stock treatment section and the rejects section of the device. The inner diameter of baffle 34 is slightly larger than the diameter of the center shaft housing 36 with suitable sealing means (not shown) being positioned therebetween, forming a hydraulic restriction to flow between the interior of impeller 20 and the rejects section of the device. The outer diameter of baffle 34 extends substantially circumferentially around impeller 20 and is slightly smaller than the inner diameter of screenplate 12 to permit the passage of oversized rejects and impurities retained by the screenplate into rejects section 33 to be removed through rejects outlet 35.

A shaft 38 and bearing housing 40 are centrally located in the screening apparatus. They are enclosed by the concentric center shaft housing 36 which runs the length of bearing housing 40. Shaft 38 is connected through pulley sheave 42 to suitable drive means indicated at 44. The center shaft housing 36 accomodates pipes 46 and 48 which supply dilution water into chambers 50 and 52, respectively, in the interior of impeller 20. Housing 36 also provides the internal sealing surface, through suitable sealing means (not shown), for chambers 50 and 52.

As a fiber slurry enters the inlet section of the apparatus, a large portion of the short, good fibers as well as substantial water in the slurry is accepted through screenplate 12 and removed through accepts outlet 54 from the screening apparatus. To compensate for the increased consistency of the slurry, dilution water is added to the central stock treatment section from chamber 50 through holes 55 in the lower portion 28 of impeller 20. In addition, dilution water is supplied from chamber 52 through holes 57 in the lowermost portion of impeller 20 to wash any remaining good fibers through the screenplate prior to the entry of the slurry into rejects section 33. In this manner, the dilution water will be mixed with the slurry as far as possible away from the screenplate to avoid disturbing the mat formed by the alignment of fibers.

The flow requirements for the two dilution water chambers 50 and 52 are different, and to obtain maximum operating efficiency, the flow of dilution water to each chamber is separately controlled through pipes 46 and 48. Inside the lower portion 28 of impeller 20 a horizontal baffle or plate 56 separates chambers 50 and 52 from one another. Baffle 56 may be welded or otherwise securely fastened to the inner wall of impeller 20 and forms a narrow clearance with the walls of the center shaft housing 36 which also houses the dilution water pipes. Due to the centrifugal force created by the rotation of impeller 20, the dilution water supplied to chambers 50 and 52 is thrown outwardly against the wall of the impeller with only slight leakage and equalization of fluid pressure taking place between the two chambers. In this manner, the screening process can be controlled effectively by varying the flow of dilution water to the two chambers.

To reinforce and stabilize blades 22, a circular ring 58 is welded or otherwise fastened to their top edges. The outside diameter of the ring is substantially the same as the inside diameter of screenplate 12, allowing only a minimum of clearance. The inside diameter of the ring is such that it will cover approximately one half of the space between screenplate 12 and upper portion 26 of impeller 20. In addition to reinforcing and stabilizing blades 22, ring 58 aids in better distribution of the incoming slurry, improves the circulation of the slurry in the inlet section of the screening apparatus, and encourages movement of the slurry axially inside the apparatus.

The rejects section 33 of the apparatus is defined by horizontal baffle 34, center shaft housing 36, and base 24. When the slurry reaches this rejects section, it has been fairly well dewatered. Additional dilution water may be added through pipe 60 to wash any remaining good fibers through screenplate 12. After permitting any excess water to drain through screenplate 12, the concentrated rejects and other impurities may be removed via rejects outlet 35 which communicates through base 24 with the rejects section.

As discussed above, the inlet section of the apparatus is designed for maximum acceptance of good short fibers from an incoming slurry. For this purpose, smaller perforations, either holes or slots, may be used in the section of the screenplate directly opposite the inlet section. Larger screenplate perforations may be used in the area of the screenplate opposite chamber 50 since the slurry is rich in pliable, long fibers at this stage of the screening. Because much dilution water should be added to the slurry from chamber 52 to wash away the remaining good fibers in the slurry from the rejects, smaller screen perforations should be used directly across from that chamber. This is because the distance between good fibers has been increased due to the dilution water and there is an increased chance that unacceptable fibers may be washed through the screenplate. These small screen perforations should also be used in the portion of the screenplate opposite the rejects section to avoid the passage of any unacceptable fibers through the screen.

While the apparatus herein described constitutes a preferred embodiment of the invention, it is to be understood that the invention is not limited to this precise apparatus, and that changes may be made without departing from the scope of the invention, which is defined in the appended claims.

What is claimed is:

1. A pressurized rotary screening apparatus comprising a pressurized housing having an upper stock inlet chamber having a tangentially disposed stock inlet, a lower stock screening chamber with a rejects discharge outlet, and an outer annular accepts chamber, said stock screening chamber having a generally cylindrical screenplate with rotary impeller means extending at least a portion of the length of the screenplate and mounted for axial rotation within the screenplate, said rotary impeller means having at least one rotor blade attached thereto and extending outwardly to within a short distance of the radially inwardly facing surface of said screenplate, said rotary impeller means additionally having a plurality of generally horizontally oriented baffle means extending substantially circumferentially around said impeller means and dividing the area between said rotary impeller means and said screenplate into at least three stock treatment sections.

2. The apparatus of claim 1 in which said rotary impeller means comprises a generally cylindrical upper portion and a frustoconically shaped lower portion, said upper portion having a diameter less than said lower portion.

3. The apparatus of claim 2 in which said upper and lower portions are separated by a generally horizontally oriented baffle means which defines a boundary between an inlet stock treatment section and a central stock treatment section.

4. The apparatus of claim 3 in which the lower edge of said rotary impeller means has a generally horizontally oriented baffle means extending outwardly there from separating the central stock treatment section from a stock rejects treatment section and inwardly therefrom forming a restriction to flow between the interior of said rotary impeller means and said rejects treatment section.

5. The apparatus of claim 4 in which said lower portion of said rotary impeller means contains perforations.

6. The apparatus of claim 5 further including piping means to supply dilution water through said perforations in said rotary impeller means to said central stock treatment section and said rejects treatment section.

7. The apparatus of claim 6 further including a generally horizontally oriented baffle means on said lower portion of said rotary impeller means and extending inwardly therefrom to define separate dilution water chambers.

8. The apparatus of claim 7 including separately controlled dilution water piping means to each of said dilution water chambers.

9. The apparatus of claim 3 in which the portion of the screenplate opposite the upper portion of said central stock treatment section has larger diameter perforations than the remainder of said screenplate.

10. The apparatus of claim 1 in which an upper portion of said screenplate has smaller diameter performations than the remainder of said screenplate.

* * * * *